US008127803B2

(12) United States Patent
Kusakari

(10) Patent No.: US 8,127,803 B2
(45) Date of Patent: Mar. 6, 2012

(54) REINFORCING BAR BINDING MACHINE

(75) Inventor: Ichiro Kusakari, Tokyo (JP)

(73) Assignee: Max Co., Ltd., Chuo-ku, Tokyo (JP)

( * ) Notice: Subject to any disclaimer, the term of this patent is extended or adjusted under 35 U.S.C. 154(b) by 371 days.

(21) Appl. No.: 12/465,887

(22) Filed: May 14, 2009

(65) Prior Publication Data

US 2009/0283168 A1 Nov. 19, 2009

(30) Foreign Application Priority Data

May 19, 2008 (JP) ..... 2008-130644
Feb. 10, 2009 (JP) ..... 2009-028658

(51) Int. Cl.
*B21F 15/04* (2006.01)
*B21F 11/00* (2006.01)
*B21F 9/00* (2006.01)
*B21F 9/02* (2006.01)

(52) U.S. Cl. ..... 140/123.6; 140/93.2

(58) Field of Classification Search ..... 140/123.5, 140/123.6, 117–119, 93.2, 93 R; 53/139.4, 53/137.2, 139.1, 414; 100/28, 32, 25–26
See application file for complete search history.

(56) References Cited

U.S. PATENT DOCUMENTS 4,586,667 A * 5/1986 Rodenbeck ..... 140/92.1
(Continued)

FOREIGN PATENT DOCUMENTS

EP 0 886 020 A1 12/1998
(Continued)

*Primary Examiner* — Dana Ross
*Assistant Examiner* — Mohammad I Yusuf
(74) *Attorney, Agent, or Firm* — Drinker Biddle & Reath LLP

(57) ABSTRACT

A reinforcing bar binding machine is provided with: a guide tube for guiding a wire from a wire reel mounted on a binding machine body; a curl guide; a wire cutting mechanism disposed between the guide tube and the curl guide; a first guide pin that is disposed at an end portion of the guide tube or in a vicinity of the end portion of the guide tube, and guides an outer side surface which is an outer side of a wire curve; a second guide pin that is disposed at the end portion of the guide tube or in a vicinity of the end portion of the guide tube, and guides an inner side surface which is an inner side of the wire curve; and a third guide pin that is disposed inside of the curl guide and guides the outer side surface. The wire is brought into contact with the first guide pin, the second guide pin, and the third guide pin, when the wire is fed around a reinforcing bar.

6 Claims, 8 Drawing Sheets

U.S. PATENT DOCUMENTS 5,778,946 A * 7/1998 Pellenc et al. ..... 140/119

FOREIGN PATENT DOCUMENTS

| | | |
|---|---|---|
| JP | 7-2201 | 1/1995 |
| JP | 7-48931 | 2/1995 |
| JP | 08-277632 | 10/1996 |
| JP | 3-010353 | 2/2000 |
| JP | 2000-064617 | 2/2000 |
| JP | 3496463 | 11/2003 |
| WO | WO 2007/042785 A2 | 4/2007 |

* cited by examiner

REINFORCING BAR BINDING MACHINE

BACKGROUND OF THE INVENTION

1. Field of the Invention

The present invention relates to a reinforcing bar binding machine in which a wire pulled out from a wire reel is fed to a guide part provided on the tip end of a binding machine body, curled by the guide part and fed out to the circumference of the reinforcing bars arranged inside the guide part, and looped and wound around the reinforcing bars and twisted to bind the reinforcing bars.

2. Background Art

A reinforcing bar binding wire is pulled out from the wire reel, and fed out from a guide part on the binding machine tip end while being curled, and looped and wound around reinforcing bars, and at the guide part, the wire must be curled and fed out. In order to curl the wire, the wire should be bent by at least three points.

That is, the guide part includes three components arranged in order, an end portion of a guide tube which guides feeding of the wire from the wire reel, a wire cutting mechanism for cutting the wire after feeding out a predetermined amount of the wire, and a curl guide which curves the wire fed from the wire cutting mechanism (refer to JP-B2-3496463). These three components have functions for cutting the wire and guiding the wire, and these are used as said three points for curling the wire.

However, the above-described configuration has the following problems.

The three components have complicated shapes, and easily vary in dimensions and attaching positions. Therefore, these may pose problems that the curl diameter of the wire fed out from the guide part is excessively small and the hooks cannot grasp the wire, or the curl diameter is excessively large and the end portion of the wire returned after being looped cannot enter a curl pickup guide of the guide part. Therefore, dimensional control is very troublesome and the component cost increases.

Further, the three components which curl the wire are always worn by the iron-made wire, so that they are worn, and in particular, a portion which forms a curl on the wire is greatly worn, and this wearing increases the wire feeding resistance and deteriorates the smoothness of the wire feeding, and during repetition of use, the curling is deteriorated, and the curl diameter of the wire becomes larger, so that for guiding the wire, the components need to be replaced. It is possible that the components are hardened to cope with the problem of wearing, however, the shapes of the components are complicated, so that selection of the material (hardness) is limited.

Further, for curling the wire, one point in said three points must be always disposed on the inner side of the wire (portion which becomes the inner side of the curl) without fail. When this portion is disposed on the tip of the wire cutting mechanism, wire cutting swarf may remain at the guide part. In this case, if the next binding operation is performed without knowing the swarf, the next wire jams at the guide part and it is troublesome to take this out.

SUMMARY OF THE INVENTION

One or more embodiments of the present invention provide a reinforcing bar binding machine which can curl a wire with high accuracy.

In accordance with one or more embodiments of the invention, a reinforcing bar binding machine is provided with: a guide tube 8 for guiding a wire 5 from a wire reel 4 mounted on a binding machine body 2; a curl guide 12; a wire cutting mechanism 11 disposed between the guide tube 8 and the curl guide 12; a first guide pin 23 that is disposed at an end portion of the guide tube 8 or in a vicinity of the end portion of the guide tube 8, and guides an outer side surface which is an outer side of a wire curve; a second guide pin 24 that is disposed at the end portion of the guide tube 8 or in a vicinity of the end portion of the guide tube 8, and guides an inner side surface which is an inner side of the wire curve; and a third guide pin 25 that is disposed inside of the curl guide 12 and guides the outer side surface. The wire 5 is brought into contact with the first guide pin 23, the second guide pin 24, and the third guide pin 25, when the wire 5 is fed around a reinforcing bar.

In the above configuration, on a guide part of the reinforcing bar binding machine, an end portion of a guide tube which guides feeding of the wire from the wire reel, a wire cutting mechanism for cutting the wire after feeding out a predetermined amount of the wire, and a curl guide which guides the wire fed from the wire cutting mechanism so that the wire is curled, are disposed in order, and at or near the end portion of the guide tube, a first guide pin and a second guide pin for guiding the outer side surface and the inner side surface of the wire are disposed, and a third guide pin for guiding the outer side surface of the wire is provided inside the tip end inner side of the curl guide, and when feeding the wire, the wire is brought into contact with the first guide pin, the second guide pin, and the third guide pin.

Thus, the first to third guide pins have simple shapes, so that dimensional variations thereof are easily suppressed, and the dimensional accuracy is determined by only the attaching positions of the first to third guide pins to the guide part, so that accuracy can be easily obtained. Therefore, the first to third guide pins with which the wire comes into contact are provided at correct positions, the wire is correctly curled, and the curl diameter becomes steady. Further, the first to third guide pins have simple shapes, so that a material with high hardness can be freely selected for the guide pins.

The second guide pin 24 may be disposed between the guide tube 8 and the wire cutting mechanism 11.

In the above configuration, the second guide pin guides the inner side surface of the wire, and it is disposed between the guide tube and the wire cutting device, so that no member which comes into contact with the inner side surface of the wire is present between the cutting mechanism and the curl guide. Therefore, wire cutting swarf falls from the guide part without fail, so that wire jamming does not occur.

The first guide pin 23, the second guide pin 24, and the third guide pin 25 may be made of a material having higher hardness than the wire 5.

In the above configuration, the first guide pin, the second guide pin, and the third guide pin are made of a material with high hardness such as carbide pins and ceramic pins, so that these guide pins are hardly worn, and portions which come into contact with the wire and are easily worn of the wire guide tube, the wire cutting mechanism, and the curl guide are not directly contacted by the wire, so that their durability can be greatly improved. Further, the material with high hardness can be acquired comparatively inexpensively if the material has a pin shape, so that the cost can be reduced to be low.

In the above configuration, sectional shapes of the first guide pin 23, the second guide pin 24, and the third guide pin 25 may be noncircular.

In the above configuration, the sectional shapes of the first guide pin, the second guide pin, and the third guide pin are noncircular such as square, rectangular, and oval, so that loosening of the guide pin can be effectively suppressed. In other words, pins having noncircular sectional shapes hardly rotate, so that loosening due to rotation during a long period of use, which easily occurs on guide pins having circular sections attached by fitting and fixing (caulking, etc.) is effectively suppressed.

Moreover, the reinforcing bar binding machine may include a wearing preventive plate 27 which is provided on a side wall 13*a* between the first guide pin 23 and the second guide pin 24, and is made of a material having higher hardness than the wire 5.

In the above configuration, a wearing preventive plate made of a material with high hardness is fitted and fixed to a guide part side wall between the first guide pin and the second guide pin, so that the side wall of the guide part which always comes into contact with the wire when curling the wire is hardly worn, and the wire can be curled normally over a long period of time, and as a result, the durability of the binding machine is improved.

The wearing preventive plate 27 may fit to a concave portion 13*e* on the side wall 13*a*, and a surface of the wearing preventive plate 27 may be pressed and fixed by a tip end of the first guide pin 23 and a tip end of the second guide pin 24.

In the above configuration, the wearing preventive plate is fitted to a concave portion formed on the side wall, and the surface of the wearing preventive plate is pressed and fixed by the tip ends of the first guide pin and the second guide pin, so that the wearing preventive plate can be easily and reliably fixed without a fixing means such as screwing and welding, etc., and the surface of the wearing preventive plate becomes flush with the wall surface of the side wall and makes the wire passage smooth.

Other aspects and advantages of the invention will be apparent from the following description, the drawings and the claims.

DETAILED DESCRIPTION OF THE EXEMPLARY EMBODIMENTS

Exemplary embodiments of the invention are described in reference to drawings.

Figure 1:
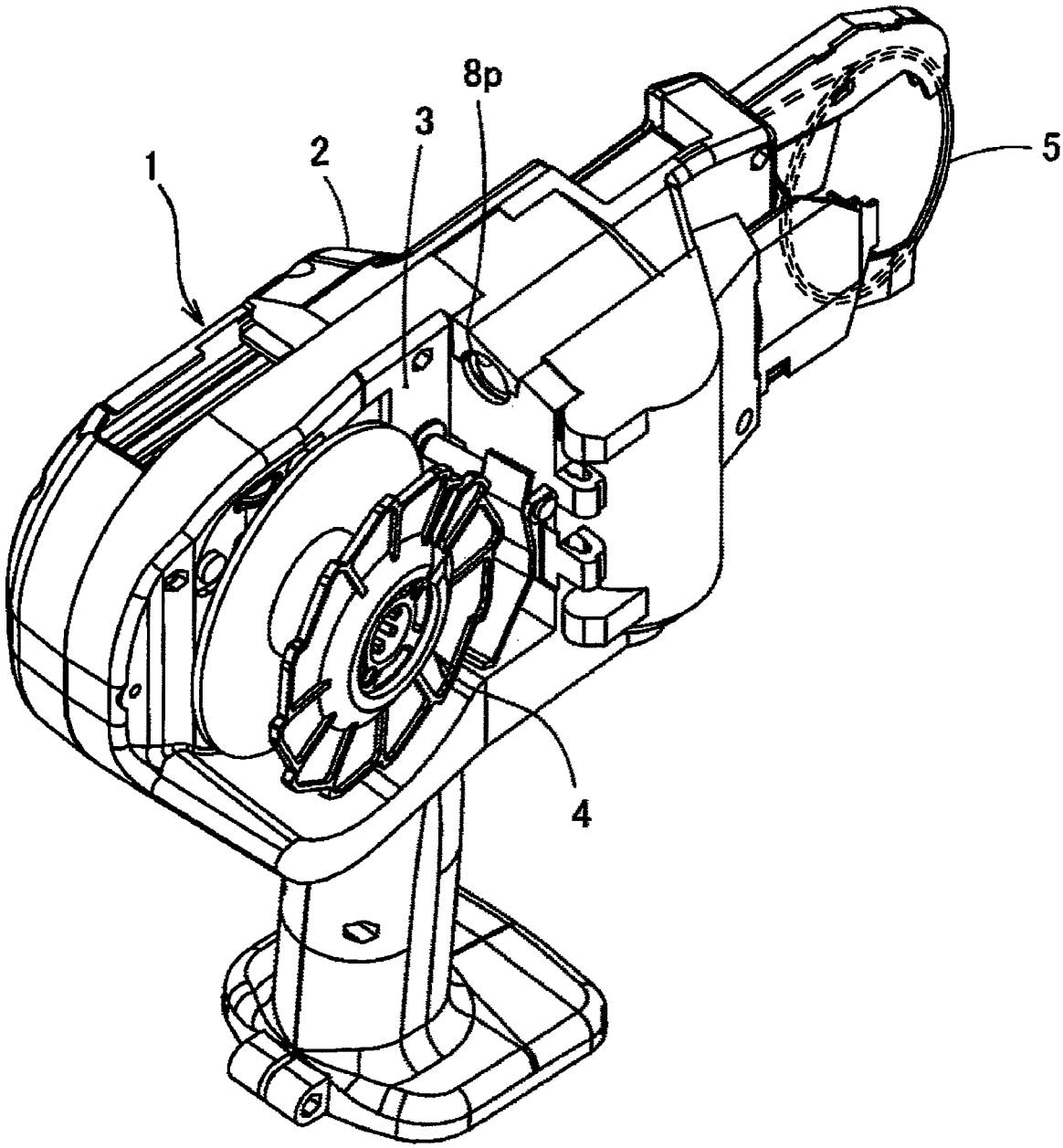
FIG. 1 is a perspective view showing a state where a cover on one side of a reinforcing bar binding machine is removed in an embodiment of the present invention.
Figure 2:
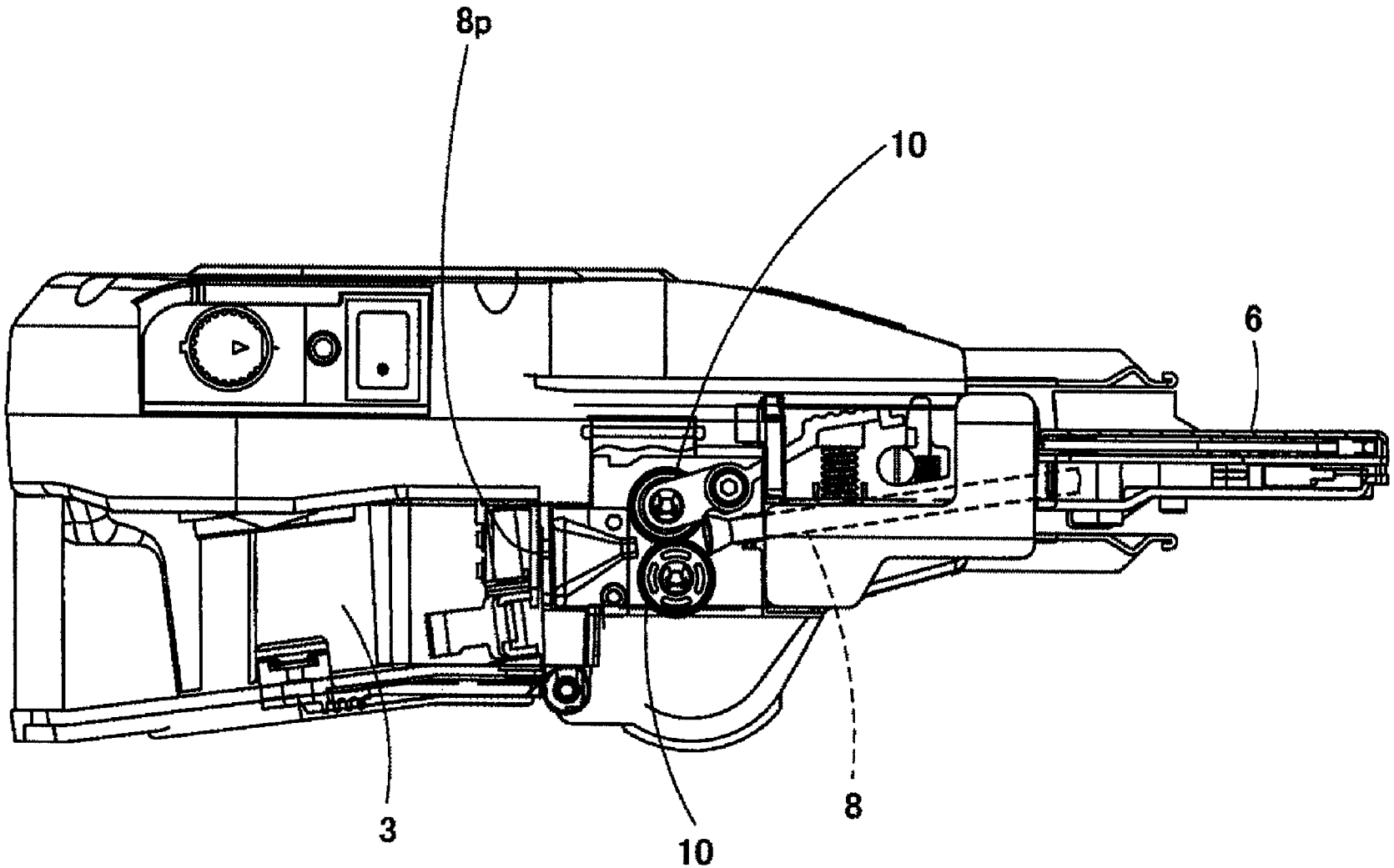
FIG. 2 is a plan view showing an essential portion of the upper surface of the reinforcing bar binding machine.
Figure 3:
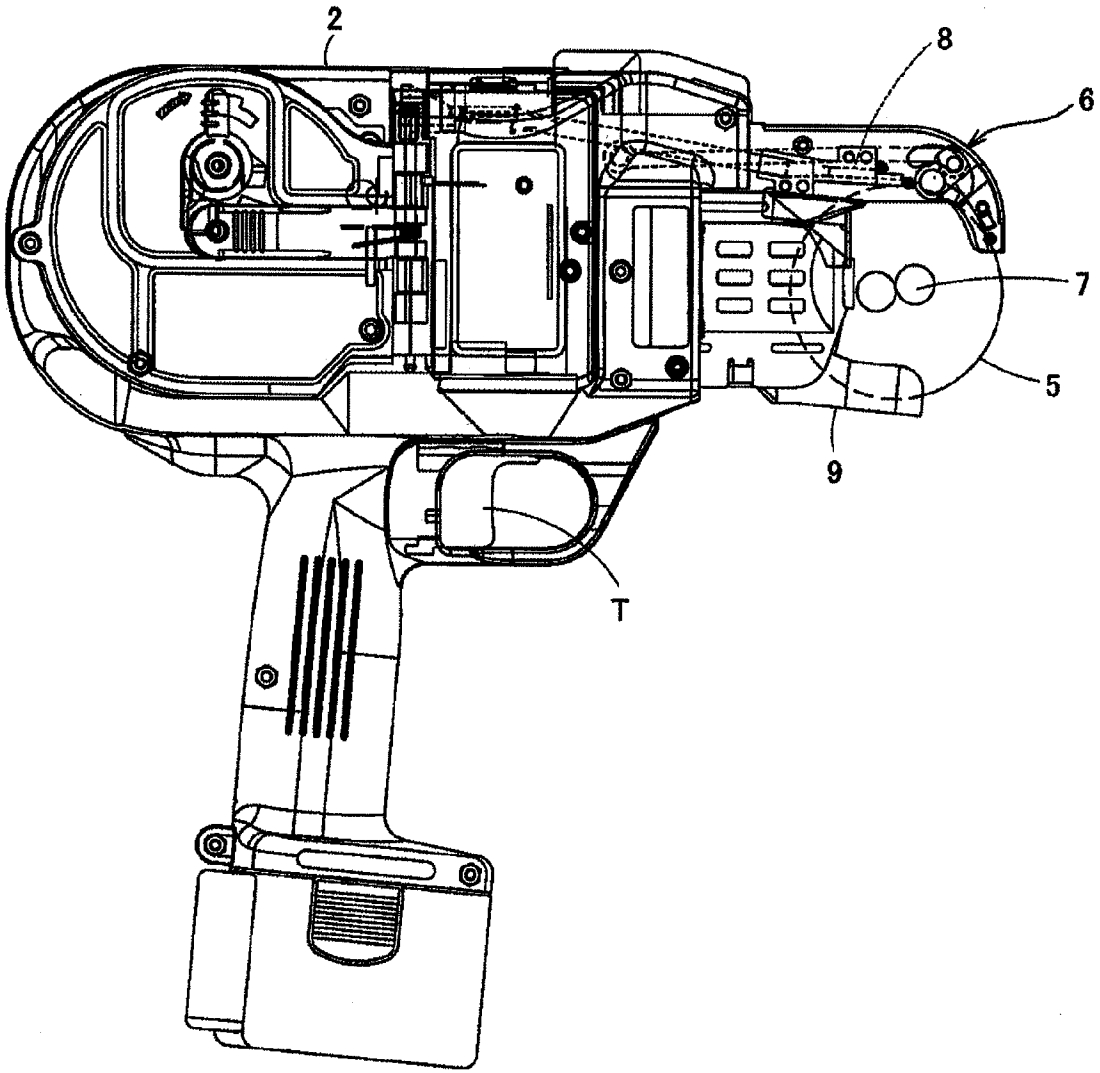
FIG. 3 is a side view of the reinforcing bar binding machine.

In FIG. 1 to FIG. 3, the reference numeral 1 denotes a reinforcing bar binding machine. In the reinforcing bar binding machine 1, a wire reel 4 around which a reinforcing bar binding wire 5 is wound is fitted in a housing chamber 3 provided in a binding machine body 2, and the wire 5 is fed to a guide part 6 provided on the tip end of the binding machine body 2 while the wire reel 4 is rotated, and curled by the guide part 6 and fed out to the circumference of reinforcing bars 7 arranged inside the guide part 6 and wound around the reinforcing bars, and then the root side of the wire 5 is cut and the wound portion is twisted to bind the reinforcing bars 7.

In the binding machine body 2, a guide tube 8 through which the wire 5 pulled out from the wire reel 4 is inserted is provided. One end 8*p* (see FIG. 1) of the guide tube 8 is opened to the housing chamber 3, and the other end is positioned in front of the guide part 6. At the middle of the guide tube 8, as a means for feeding the wire 5, as shown in FIG. 2, a pair of feed gears 10 are disposed. The wire 5 is sandwiched between feed grooves formed on the pair of wire feed gears 10, and the wire 5 is fed forward by an electric motor (not shown).

When a switch is turned ON by a trigger T, the electric motor (not shown) rotates and the wire feed gears 10 rotate. Then, according to the rotation of the wire feed gears 10, the wire 5 wound around the wire reel 4 housed in the housing chamber 3 is fed forward of the binding machine body 2 through the guide tube 8.

On the tip of the guide tube 8, a guide part 6 is formed which curls the wire 5 so that the wire 5 fed into the binding machine body 2 is delivered while being curled. The guide part 6 is formed of a guide frame 13, and the guide frame 13 includes a pair of frame plates 13*a* and 13*b* (see FIG. 4 and FIG. 5), and to one frame plate 13*a*, the other frame plate 13*b* is fitted, and the tip end of the guide part 6 is curved into an arc shape, and here, the wire is curled and circled around the reinforcing bars 7 between the guide part and the lower guide 9.

In the guide part 6, a curling mechanism which curls the wire 5 guided straight inside the guide tube 8 and feeds it out is provided.

Figure 4:
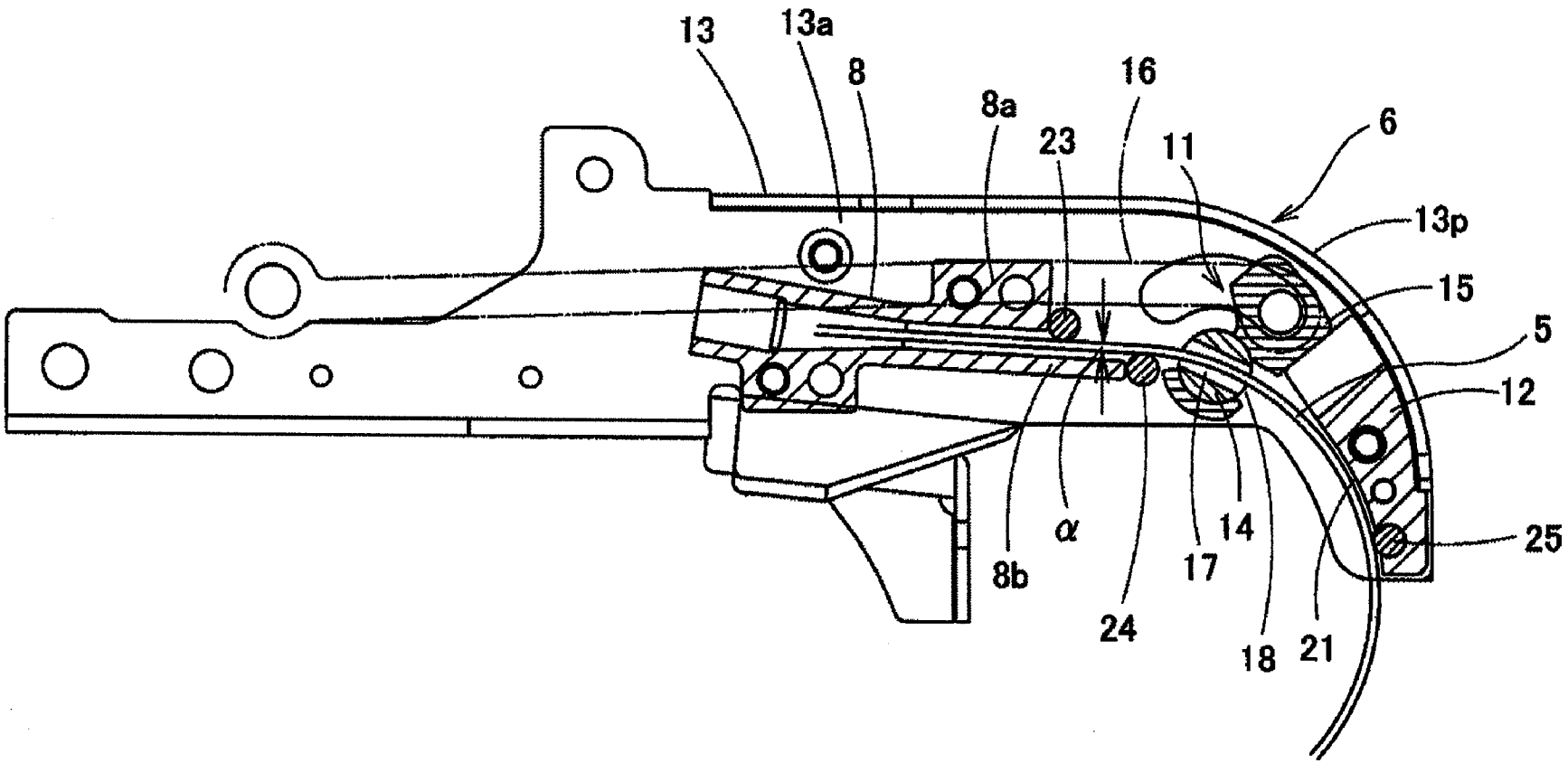
FIG. 4 is a side view of an essential portion of a curling mechanism.
Figure 5:
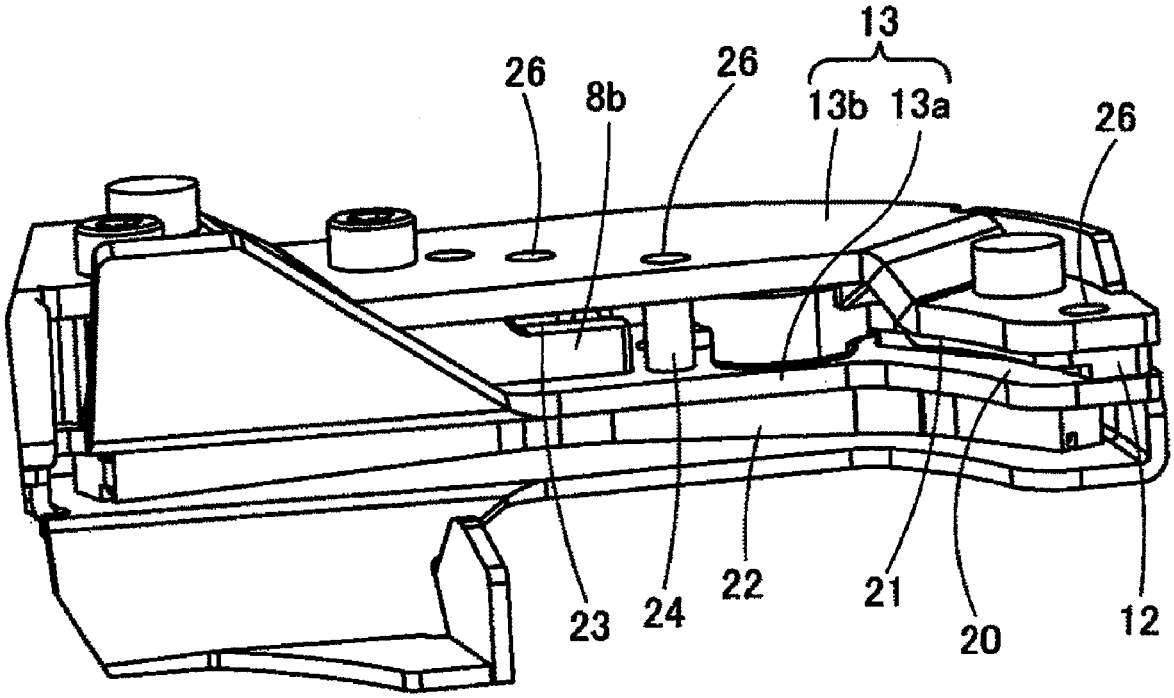
FIG. 5 is a perspective view of a wire guide part from below.

In other words, as shown in FIG. 4 and FIG. 5, on the guide frame 13 forming the guide part 6, an end portion of the guide tube 8 which guides feeding of the wire 5 from the wire reel, a wire cutting mechanism 11 for cutting the wire 5 after feeding out a predetermined amount of the wire, an a curl guide 12 which curves the wire 5 fed through the wire cutting mechanism 11 are arranged and fixed in order.

The end portion of the guide tube 8 is disposed at the base portion of the curved portion near the tip end of the guide frame 13. The end portion of the guide tube 8 is narrowed so that the wire 5 is led out from a predetermined position. The led-out wire 5 is fed out by a predetermined amount and wound around reinforcing bars 7, and then cut by the cutting mechanism 11.

The wire cutting mechanism 11 is configured so as to cut the wire 5 when the feeding amount of the wire 5 reaches a predetermined amount. In other words, the wire cutting mechanism 11 includes a shaft-shaped cutting die 14 fixed to the guide frame 13, a cutter main body 15 provided so as to turn around the cutting die 14, and a drive lever 16 which turns the cutter main body 15. A wire through hole 17 along the feeding direction of the wire 5 is formed through the cutting die 14. The cutter main body 15 turns so that its edge portion moves along the opening surface 18 on the end portion of the curl guide 12 side of the wire through hole 17, and after inserting the wire 5 through the wire through hole 17, the cutter main body 15 is turned by the drive lever 16, and the edge portion is moved along the opening surface on the end portion on the curl guide 12 side of the wire through hole 17, and accordingly, the wire 5 is cut. One end of the wire through hole 17 opens to the end portion of the guide tube 8, and the other end opens to the curl guide 12. The diameter of the wire through hole 17 is formed so as not to come into contact with the wire 5 when the wire 5 fed from the guide tube 8 is inserted through and passes through the wire through hole.

Next, the curl guide 12 is fixed to the curved portion 13*p* of the guide frame 13, and as shown in FIG. 5, a guide groove 20 allowing one wire 5 to pass through is formed by using frame plates 13*a* and 13*b* on both sides of the guide frame 13 as groove walls. On the groove bottom, a guide surface 21 which guides the wire 5 inserted through the cutting die 14 in a direction of curling is formed in an arc shape.

As shown in FIG. 5, on the guide part 6, a curl pickup guide 22 is formed adjacent to the curl guide 12. This curl pickup guide picks up the end portion of the wire 5 which was fed out from the curl guide 12 and looped and circled and then returned, and guides the wire for the next circling.

In the above-described configuration, the wire 5 fed out from the guide tube 8 is further fed out along the guide surface 21 of the curl guide 12 through the wire through hole 17 of the cutting die 14, and the guide surface comes into contact with the wire with a fixed pressure according to the feed speed of the wire 5, so that the wire 5 is curved and curled.

At the end portion of the guide tube 8, a first guide pin 23 is provided on the upper portion of FIG. 4, and a second guide pin 24 is provided on the lower portion. The tip end upper portion 8*a* of the guide tube 8 is cut, and the lower portion 8*b* is extended. The first guide pin 23 and the second guide pin 24 are formed of columnar members having circular sections, and both ends thereof are fitted and fixed to holes 26 formed in the frame plates 13*a* and 13*b* on both sides of the guide frame 13, and the circumferential surface of the first guide pin 23 comes into contact with the end portion face of the tip end upper portion 8*a* of the guide tube 8, and the peripheral surface of the second guide pin 24 comes into contact with the end portion face of the tip end lower portion 8*b* of the guide tube 8, and project to the inside of the guide tube 8, and the interval $\alpha$ between the lower end of the peripheral surface of the first guide pin 23 and the upper end of the peripheral surface of the second guide pin 24 is set substantially equal to the diameter of the wire 5. Accordingly, for passage of the wire, the outer side surface on the outer side of the curve of the wire 5 is guided by the first guide pin 23 and the inner side surface on the inner side of the curve of the wire 5 is guided by the second guide pin 24. Instead of fixation of both ends of the first and second guide pins 23 and 24 to the frame plates 13*a* and 13*b*, the first and second guide pins may be fixed to either one of the frame plate 13*a* or 13*b*.

Inside the tip end of the curl guide 12, a third guide pin 25 is provided. The third guide pin 25 is also fitted and fixed to the holes 26 formed in the guide frame 13, and attached so as to project slightly more inward than the guide surface of the curl guide 12. Therefore, the outer side surface of the curve of the wire 5 fed out along the guide surface 21 of the curl guide 12 comes into contact with the third guide pin 25 and is fed downward of FIG. 4.

Preferably, the first to third guide pins 23 to 25 are made of a material with high hardness such as carbide pins and ceramic pins.

Thus, the wire 5 comes into contact with the first guide pin 23, the second guide pin 24, and the third guide pin 25, and is curled. The portions which conventionally come into contact with the wire 5 and are worn such as the tip end portion of the guide tube 8 for the wire 5, the wire through hole 17 of the wire cutting die 14, and the tip end portion of the curl guide 12, do not come into direct contact with the wire 5.

As described above, on the tip end of the guide tube 8, the first guide pin 23 and the second guide pin 24 are disposed, and when the wire 5 is fed out from the guide tube 8, the wire 5 is guided by the first guide pin 23 and the second guide pin 24 and pass through the cutting die 14 without direct contact with the tip end of the guide tube 8. At this time, the interval between the lower end of the first guide pin 23 and the upper end of the second guide pin 24 is set substantially equal to the diameter of the wire 5, and the outer side surface and the inner side surface of the curve of the wire 5 come into contact with and are guided by the first guide pin 23 and the second guide pin 24, so that the wire is accurately fed. Therefore, the wire 5 is fed without contact with the inner surface of the wire through hole 17 of the cutting die 14. Then, the wire 5 is fed out while wearing against the tip end of the curl guide 12, and is strongly curved. Although the tip end of the guide tube 8 and the wire through hole 17 of the cutting die 14, or the tip end of the guide surface 21 of the curl guide 12 are easily worn by repetitive friction, and if these portions are worn out, this affects the curl diameter, however, on the tip end of the guide tube 8, the first guide pin 23 and the second guide pin 24 are provided, and inside the tip end of the curl guide 12, the third guide pin 25 is provided, and the wire 5 comes into contact with the first to third guide pins 23 to 25, and does not come into direct contact with the tip end of the guide tube 8, the cutting die 14, and the guide surface 21. Therefore, the tip end of the guide surface is not worn.

As described above, when the first to third guide pins 23 to 25 are provided at correct positions, the curl diameter becomes steady. The first to third guide pins 23 to 25 have simple shapes, so that the dimensional variation is easily suppressed, and the dimensional accuracy is determined by only the attaching positions of the first to third guide pins 23 to 25 to the guide part 6, so that the accuracy can be easily obtained, and the curl diameter becomes steady. In addition, the first to third guide pins 23 to 25 have simple shapes, so that a material with high hardness can be freely selected.

The second guide pin 24 guides the inner side surface of the wire 5, and is disposed between the guide tube 8 and the cutting die 14, so that no member which comes into contact with the inner side surface of the wire 5 is present between the cutting mechanism 11 and the curl guide 12. Therefore, cutting swarf of the cut wire 5 falls from the guide part 6 without fail, so that jamming of the wire 5 does not occur.

Further, by making the first guide pin 23, the second guide pin 24, and the third guide pin 25 of a material with high hardness like carbide pins and ceramic pins, these guide pins are hardly worn, and the portions which are conventionally worn due to contact with the wire 5 of the guide tube 8 for the wire 5, the wire cutting mechanism 11, and the curl guide 12 do not come into direct contact with the wire 5, so that durability can be greatly improved. In addition, the material with high hardness can be acquired comparatively inexpensively if the material has a pin shape, so that the cost can be reduced to be low.

Further, after the wire 5 is curled by the guide part 6 and fed out to the circumference of the reinforcing bars 7 arranged inside the guide part 6 and wound around the reinforcing bars, the root side of the wire 5 is cut by the cutting mechanism 11, and the wound portion is twisted by the twisting device to bind the reinforcing bars 7.

Figure 6A:
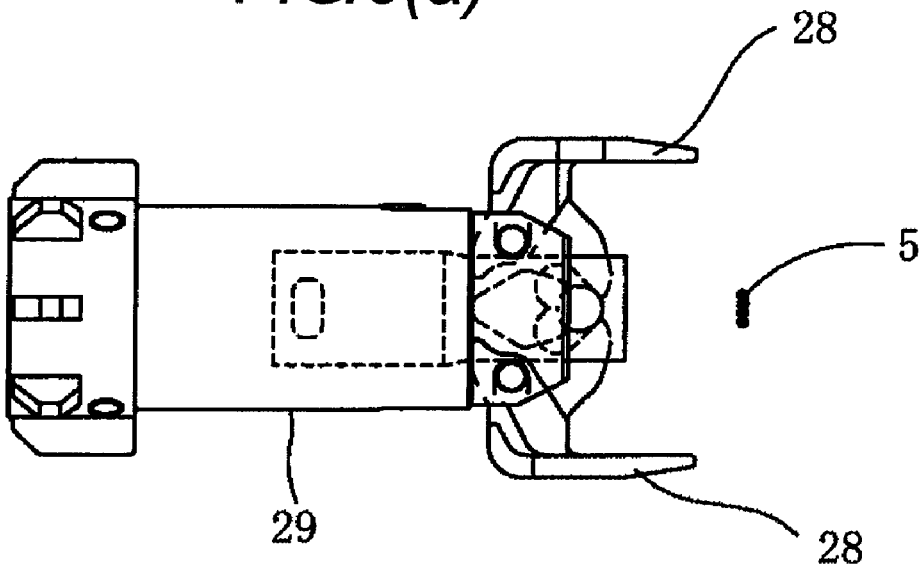
FIGS. 6(*a*), FIG. 6(*b*), and FIG. 6(*c*) are actuation explanatory views of an essential portion of a twisting mechanism from above.
Figure 6B:
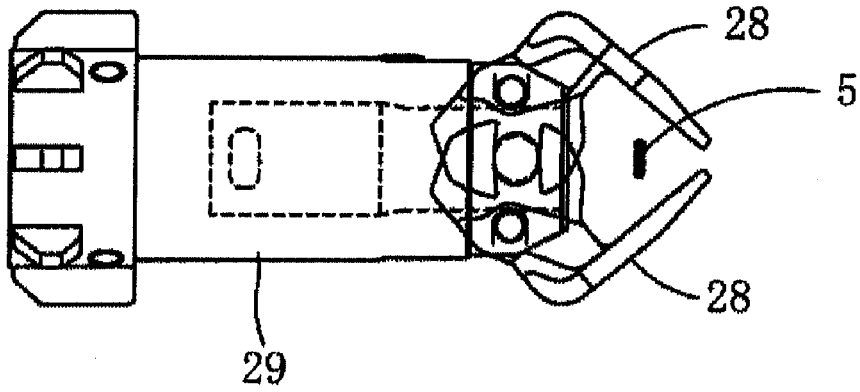
Figure 6C:
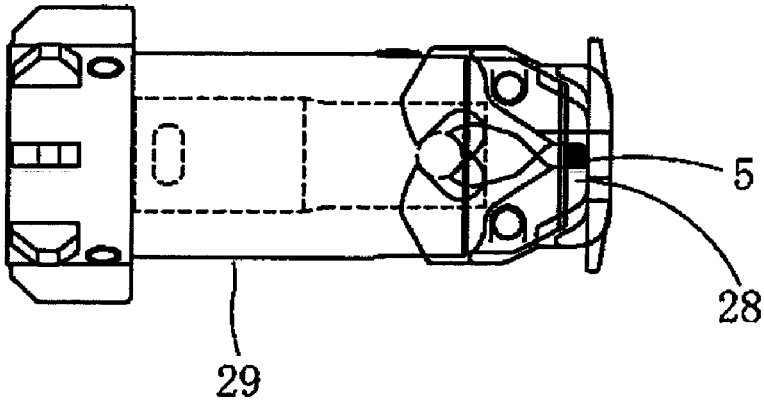
Figure 7A:
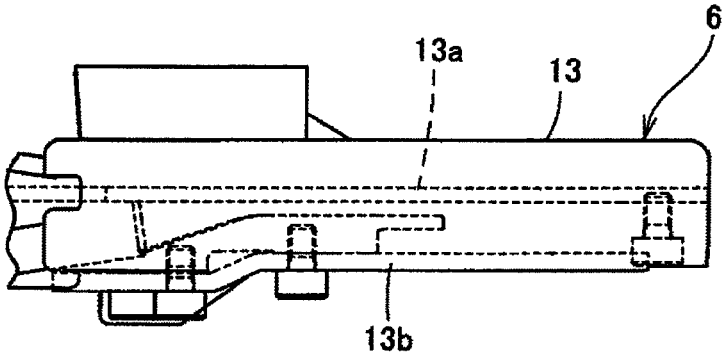
FIGS. 7 are views similar to FIG. 4 and showing a wire guide part of another embodiment, and FIG. 7 (*a*) is a plan view of the wire guide part, FIG. 7(*b*) is a side view when one of the frame plates is removed, FIG. 7(*c*) is a sectional view along the A-A of FIG. 7 (*b*), and FIG. 7(*d*) is a sectional view along the B-B of FIG. 7(*b*)
Figure 7B:
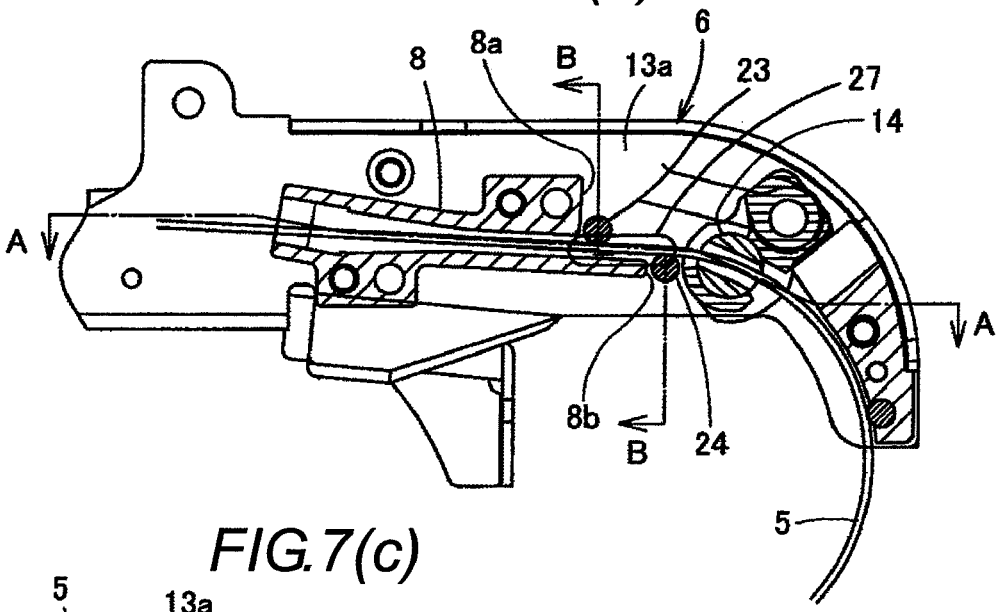
Figure 7C:
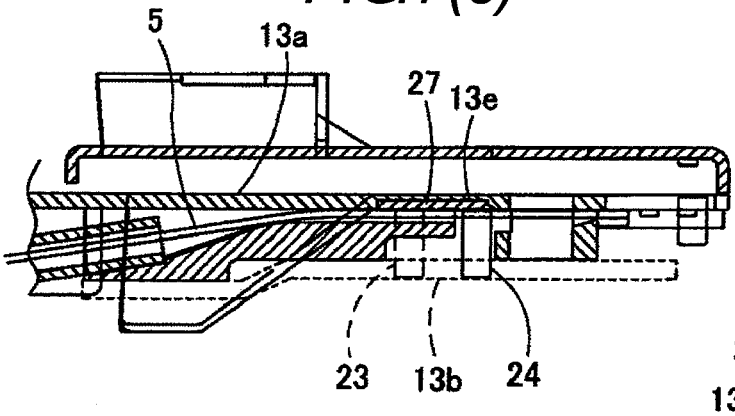
Figure 7D:
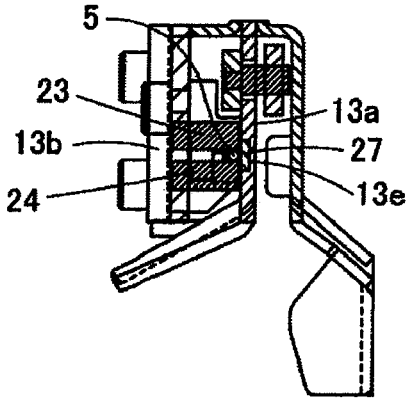

In the wire twisting device, as shown in FIG. 6(*a*) and FIG. 6(*b*), a sleeve 29 to which a pair of hooks 28 are pivotally mounted so as to open and close is advanced by the electric motor to close the hooks 28, and accordingly, the wire 5 looped and wound around the reinforcing bars is grasped as shown in FIG. 6(*c*), and then, by rotating the hooks 28 together with the sleeve 29, the wire 5 is twisted to bind the reinforcing bars, and thereafter, the hooks 28 are rotated in reverse and the sleeve 29 is retreated and separated from the wire 5 and returned to the initial position. When the sleeve advances, the drive lever 16 of the cutting mechanism 11 is actuated to cut the wire 5.

The rotation of the feed gears 10, cutting of the wire 5, and actuation of the wire twisting device are sequence-controlled by a control circuit not shown. The control circuit also measures the feeding amount of the wire 5 based on the rotation amounts of the feed gears 10.

In the above-described curling mechanism, the guide pins are required to guide the outer side and the inner side of the curve of the wire 5, and are not limited to the above-described form. In other words, in the above-described embodiment, as shown in FIG. 4, the first guide pin 23 and the second guide pin 24 are provided in contact with the end portion face of the tip end upper portion 8*a* and the end portion face of the tip end lower portion 8*b* of the guide tube 8 so as to project inward, however, the form of the guide pins is not limited to this. For example, as shown in FIG. 7(*b*) and FIG. 7(*c*), the first guide pin 23 and the second guide pin 24 may be provided near the end portion of the tip end upper portion 8*a* and the end portion of the tip end lower portion 8*b* of the guide tube 8. Alternatively, one of the first guide pin 23 and the second guide pin 24 is provided on the upper or lower end portion of the guide tube 8, and the other guide pin is provided near the lower or upper end portion. The number of guide pins may be three or more, and the first guide pin 23 may be positioned nearer the cutting die 14 than the second guide pin 24.

In the above-described embodiment, as a measure for preventing further wearing of the wire feed passage, in addition to the guide pins as points of changing the advancing direction of the wire 5, preferably, for example, the wire contact portions, etc., which curl the wire 5 are subjected to wear-resistant treatment. In other words, as shown in FIG. 7(*a*) to FIG. 7(*d*), on the side wall (frame 13*a*) of the groove between the first guide pin 23 and the second guide pin 24 of the guide part 6 with which the wire 5 normally comes into contact when passing through it, a wearing preventive plate 27 made of a material with high hardness such as a carbide plate or a ceramic plate is provided.

The wearing preventive plate 27 is fitted to a concave portion 13*e* formed on the inner side surface of the frame plate 13*a* forming one side wall of the guide part 6, and when the other frame plate 13*b* is fitted to the frame plate 13*b*, as shown in FIG. 7(*b*) and FIG. 7(*c*), portions of the tip ends of the first guide pin 23 and the second guide pin 24 fixed to the other frame plate 13*b* are brought into contact with both end portions of the wearing preventive plate 27 and pressed and fixed. Accordingly, the wearing preventive plate 27 can be easily and reliably fixed without a fixing means such as screwing and welding, etc., and the surface of the wearing preventive plate 27 becomes flush with the wall surface of the side wall (frame plate 13*a*) to make smooth the passage of the wire 5.

Wearing due to contact with the wire 5 hardly occurs according to provision of the wearing preventive plate 27, so that the wire feeding passage is prevented from deforming and is improved in durability, and the wire 5 is smoothly fed, and normal curling of the wire 5 can be performed for a long period of time.

The portion of the wire feeding passage to be subjected to wearing resistant treatment is not limited to the above-described side wall of the guide part 6, and an appropriate portion is selected as necessary.

Figure 8A:
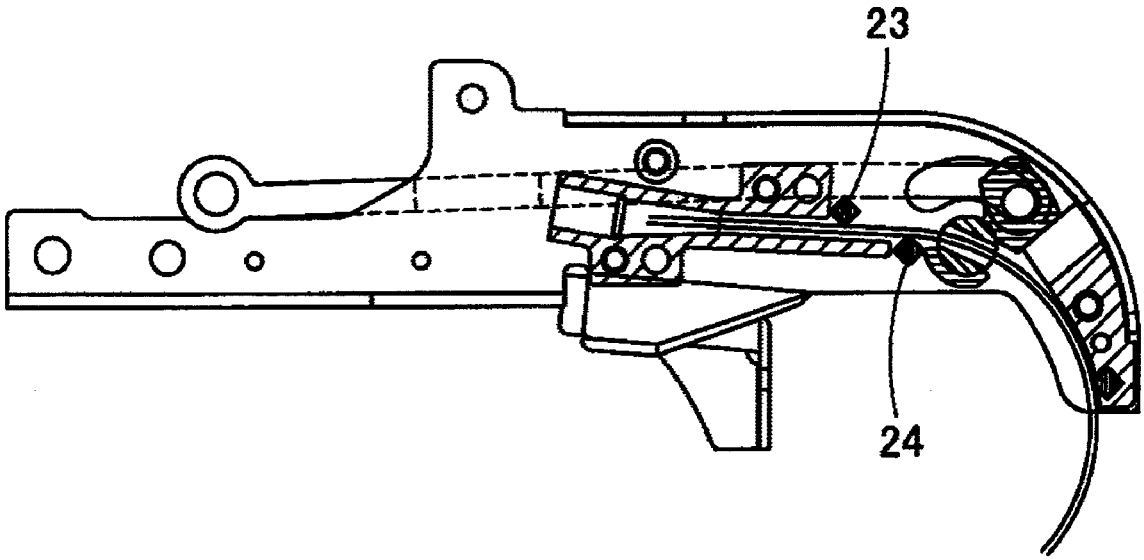
FIGS. 8 are views similar to FIG. 4 and showing a wire guide part of another embodiment, and FIG. 8(*a*) is a view when guide pins having square sectional shapes are used, and FIG. 8(*b*) is a view when guide pins having oval sectional shapes are used.
Figure 8B:
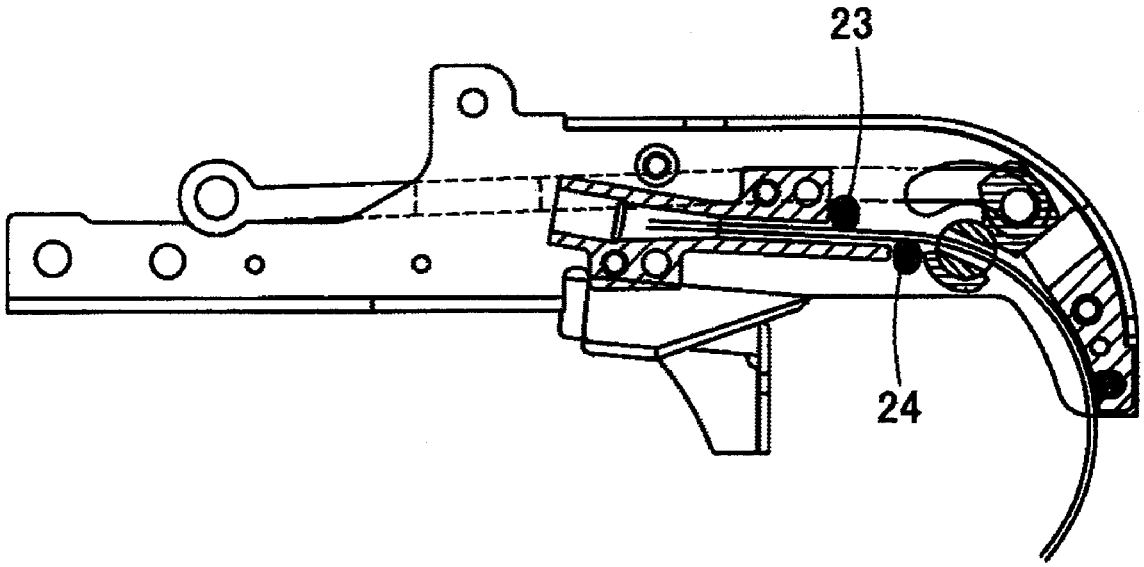

Further, in the above-described embodiment, the sectional shapes of the pin members of the first guide pin 23, the second guide pin 24, and the third guide pin 25 are circular, however, these sectional shapes may be noncircular. For example, as shown in FIG. 8(*a*), the sectional shapes may be square or rectangular, and further, may be oval as shown in FIG. 8(*b*), and members having other sectional shapes can also be used as long as they are usable as guide pins.

While description has been made in connection with specific exemplary embodiment of the invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

5 Wire
6 Guide part
8 Guide tube
11 Wire cutting mechanism
23 First guide pin
24 Second guide pin
25 Third guide pin

What is claimed is:

1. A reinforcing bar binding machine comprising:
a guide tube for guiding a wire from a wire reel mounted on a binding machine body;
a curl guide;
a wire cutting mechanism disposed between the guide tube and the curl guide;
a first guide pin that is disposed at an end portion of the guide tube or in a vicinity of the end portion of the guide tube, and guides an outer side surface which is an outer side of a wire curve;
a second guide pin that is disposed at the end portion of the guide tube or in a vicinity of the end portion of the guide tube, and guides an inner side surface which is an inner side of the wire curve; and
a third guide pin that is disposed inside of the curl guide and guides the outer side surface,
wherein the wire is brought into contact with the first guide pin, the second guide pin, and the third guide pin, when the wire is fed around a reinforcing bar.

2. The reinforcing bar binding machine according to claim 1, wherein the second guide pin is disposed between the guide tube and the wire cutting mechanism.

3. The reinforcing bar binding machine according to claim 1, wherein the first guide pin, the second guide pin, and the third guide pin are made of a material having higher hardness than the wire.

4. The reinforcing bar binding machine according to claim 1, wherein sectional shapes of the first guide pin, the second guide pin, and the third guide pin are noncircular.

5. The reinforcing bar binding machine according to claim 1, further comprising:
a wearing preventive plate which is provided on a side wall between the first guide pin and the second guide pin, and is made of a material having higher hardness than the wire.

6. The reinforcing bar binding machine according to claim 5, wherein the wearing preventive plate fits to a concave portion on the side wall, and a surface of the wearing preventive plate is pressed and fixed by a tip end of the first guide pin and a tip end of the second guide pin.

* * * * *